US009283133B2

(12) United States Patent
Sarma et al.

(10) Patent No.: US 9,283,133 B2
(45) Date of Patent: Mar. 15, 2016

(54) POSITIONING DEVICE FOR USE IN SURGICAL PROCEDURES

(71) Applicants: Jaydev Sarma, Walpole, MA (US); Shahin Tabatabaei, Newton, MA (US); Thomas Stanley Halliday, Needham, MA (US)

(72) Inventors: Jaydev Sarma, Walpole, MA (US); Shahin Tabatabaei, Newton, MA (US); Thomas Stanley Halliday, Needham, MA (US)

(73) Assignee: The General Hospital Corporation, Boston, MA (US)

( * ) Notice: Subject to any disclaimer, the term of this patent is extended or adjusted under 35 U.S.C. 154(b) by 0 days.

(21) Appl. No.: 13/902,475

(22) Filed: May 24, 2013

(65) Prior Publication Data

US 2013/0312189 A1 Nov. 28, 2013

Related U.S. Application Data

(60) Provisional application No. 61/651,438, filed on May 24, 2012.

(51) Int. Cl.
*A61G 13/12* (2006.01)
*A61G 13/10* (2006.01)

(52) U.S. Cl.
CPC ..... *A61G 13/122* (2013.01); *A61G 13/101* (2013.01); *A61G 13/121* (2013.01); *A61G 13/1225* (2013.01); *A61G 13/1235* (2013.01); *A61G 13/1255* (2013.01)

(58) Field of Classification Search
CPC ..... A61G 13/12
USPC ..... 5/621–624
See application file for complete search history.

(56) References Cited

U.S. PATENT DOCUMENTS

| | | | | |
|---|---|---|---|---|
| 4,612,678 | A * | 9/1986 | Fitsch | 5/628 |
| 5,675,851 | A * | 10/1997 | Feathers | 5/632 |
| 6,622,324 | B2 * | 9/2003 | VanSteenburg et al. | 5/621 |
| 7,063,461 | B2 * | 6/2006 | Coppens et al. | 378/208 |
| 2011/0047706 | A1 | 3/2011 | Hiebert | |

* cited by examiner

*Primary Examiner* — Fredrick Conley
(74) *Attorney, Agent, or Firm* — Quarles & Brady, LLP

(57) ABSTRACT

A device to position a patient in a selected body position, such as a Trendelenburg or flexed position, on an operating table. The device includes a board, shoulder supports removably coupled to and extending substantially perpendicular from the board, and a cushioning mat positioned to lie between the patient and the board and the shoulder supports when the patient is placed on the device. A locking mechanism removably couples the shoulder supports to the board to allow the cushioning mat to lie flat when the shoulder supports are decoupled from the board and thereby selectively provide access to a neck and shoulders of the patient when the patient is placed on the device.

15 Claims, 9 Drawing Sheets

POSITIONING DEVICE FOR USE IN SURGICAL PROCEDURES

CROSS-REFERENCE TO RELATED APPLICATIONS

This application is based on, claims priority to, and incorporates herein by reference U.S. Provisional Patent Application Ser. No. 61/651,438 filed on May 24, 2012.

STATEMENT REGARDING FEDERALLY SPONSORED RESEARCH

N/A

BACKGROUND OF THE INVENTION

The present application is directed to a device for positioning a patient and, more particularly, a device for positioning a patient during surgical procedures performed in positions such as Trendelenburg or flexed positions.

Gynecologic, urologic, colorectal, robotic, and other general surgical procedures often require a patient to be secured in a Trendelenburg position (that is, supine with feet approximately 15-30 degrees higher than head), a steep Trendelenburg position (supine with feet over about 30 degrees higher than head), or a flexed positioned (supine with hips flexed and legs spread apart). Furthermore, robotic surgical procedures require that the patient be precisely positioned relative to robotic arms and remain immobilized in the precise position throughout the procedure.

Foam pads, vacuum actuated positioning aids, and/or fabric wraps are typically used to position and immobilize patients during the above-described procedures. For example, foam pads are coupled to an operating table and contact the patient's shoulders when the patient is in the Trendelenburg position, therefore preventing the patient from sliding off the operating table. Velcro straps are also secured over the patient in order to help immobilize the patient. However, the single contact point between the foam pads and the patient's shoulders causes the patient's shoulders to receive a large amount of pressure in a concentrated area, increasing the risk for pressure-related injuries if the patient is positioned for a prolonged period of time.

Vacuum actuated positioning aids, often referred to as bean bag positioners, are bags filled with plastic pellets or microbeads. In an unevacuated state, the bag is flexible and can be formed around the patient to envelope the patient's shoulders and arms. Once the bag is positioned around the patient, the bag is evacuated using a vacuum source, forcing the microbeads together to form a solid, immobile bag molded around the patient. The bag can then contact foam pads when the patient is situated in the Trendelenburg position, allowing pressure to be distributed across a large surface area of the bag rather than on a concentrated point on the patient's shoulders. However, in addition to the time required to fill up and evacuate the bag for immobilizing or releasing a patient, the bag severely inhibits access to the patient's neck and arms. Access to the patient's arms may be required for additional intravenous lines or peripheral nerve stimulators, while access to the patient's neck may be required for CPR in an emergency situation. Thus, during an emergency, a surgeon would have to wait for the bag to be refilled so that the surgeon could move the bag to access the patient's neck.

Fabric wraps consist of multiple fabric flaps that are wrapped over a patient's body and secured, for example, by Velcro® in order to immobilize the patient. These fabric wraps do not reduce pressure points at the patient's shoulders when positioned in Trendelenburg or steep Trendelenburg positions. In addition, the fabric wraps inhibit access to the patient's arms and chest cavity. A surgeon must separate one or more flaps to access sections of the patient's body, thus reducing the immobilizing effect of the device.

Therefore, it would be desirable to provide a device that facilitates fast and easy securing of a patient in a Trendelenburg, steep Trendelenburg, or flexed position and/or other positions and that allows easy access to a patient's arms and/or neck.

SUMMARY OF THE INVENTION

The present invention overcomes the aforementioned drawbacks by providing a device to position a patient in a selected body position, such as a Trendelenburg, steep Trendelenburg, or flexed position, on an operating table. The device includes a board sized to support at least the patient's back when the patient is placed on the device and shoulder supports removably coupled to the board and extending substantially perpendicular from the board. The device also includes a cushioning mat positioned between the patient and the board and the shoulder supports when the patient is placed on the device. A locking mechanism removably couples the shoulder supports to the board to allow the cushioning mat to lie flat when the shoulder supports are decoupled from the board and thereby selectively provide access to a neck and shoulders of the patient when the patient is placed on the device.

The device may also include straps extending through slots of the board and slots of the cushioning mat to encircle the patient's arms when the patient is placed on the device. The device may further include a rod coupled to each of the shoulder supports and a clamp coupled to both the rod and the operating table to couple the device to the operating table.

These and other features and advantages of the present invention will become apparent upon reading the following detailed description when taken in conjunction with the drawings.

DETAILED DESCRIPTION OF THE INVENTION

The present invention provides a patient positioning device for maintaining a patient in a selected body position on an operating table that is rotated about a range of incline or decline positions. The device is capable of maintaining the patient's proper body position during Trendelenburg, steep Trendelenburg, flexed positions, or other positions, for example during gynecologic, urologic, colorectal, robotic, and other general medical, including surgical, procedures where the operating table is rotated about a range of inclined and declined angles from horizontal. The device facilitates fast and easy securing of a patient in such positions and allows easy access to a patient's arms and/or neck.

Figure 1:
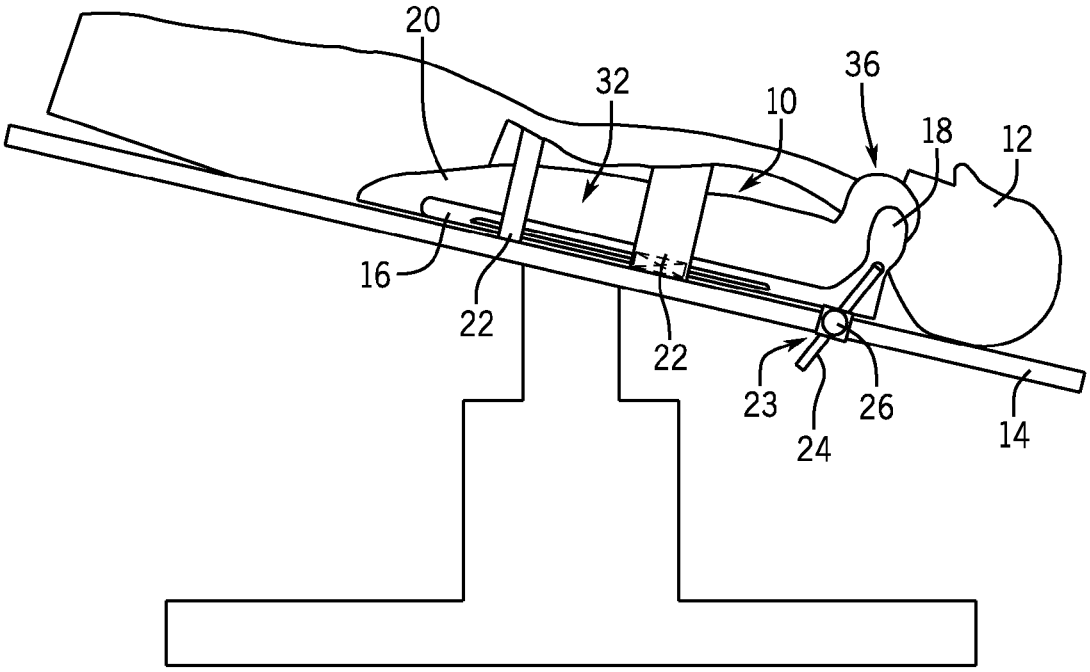
FIG. 1 is a side sagittal view of a patient and patient positioning device in accordance with one implementation of the present invention.
Figure 2:
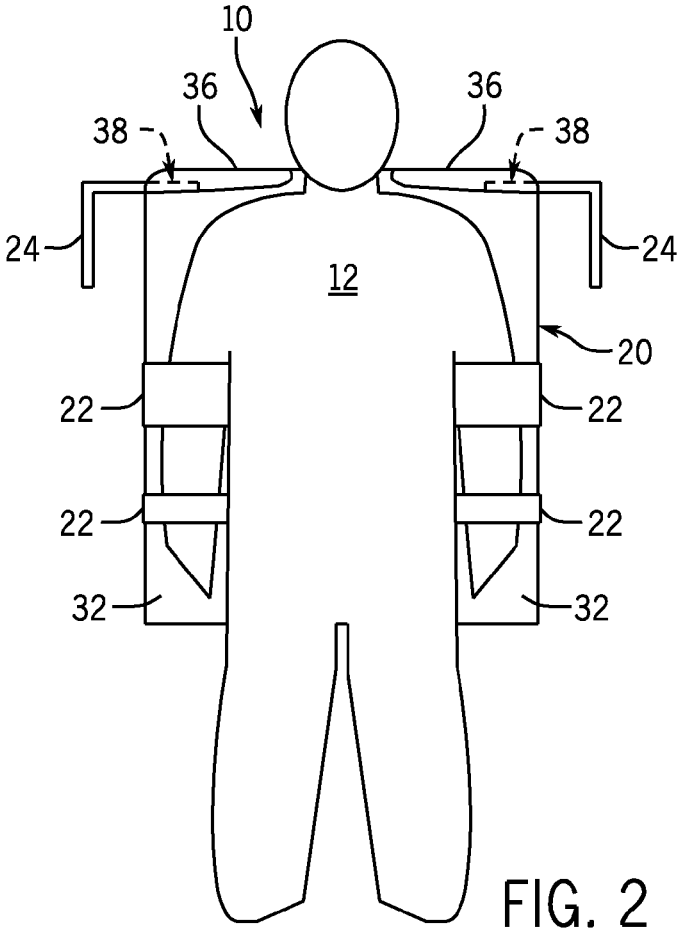
FIG. 2 is a top view of the patient and patient positioning device of FIG. 1.

FIGS. 1 and 2 illustrate a patient positioning device 10 according to one implementation of the invention. The device 10 includes a main board 16, detachable shoulder supports 18, a cushioning mat 20, and straps 22 for securing a patient 12 to the device 10. The device 10 also includes a coupling mechanism 23 (such as rods 24 and clamps 26) for securing the device 10 to an operating table 14.

Figure 4:
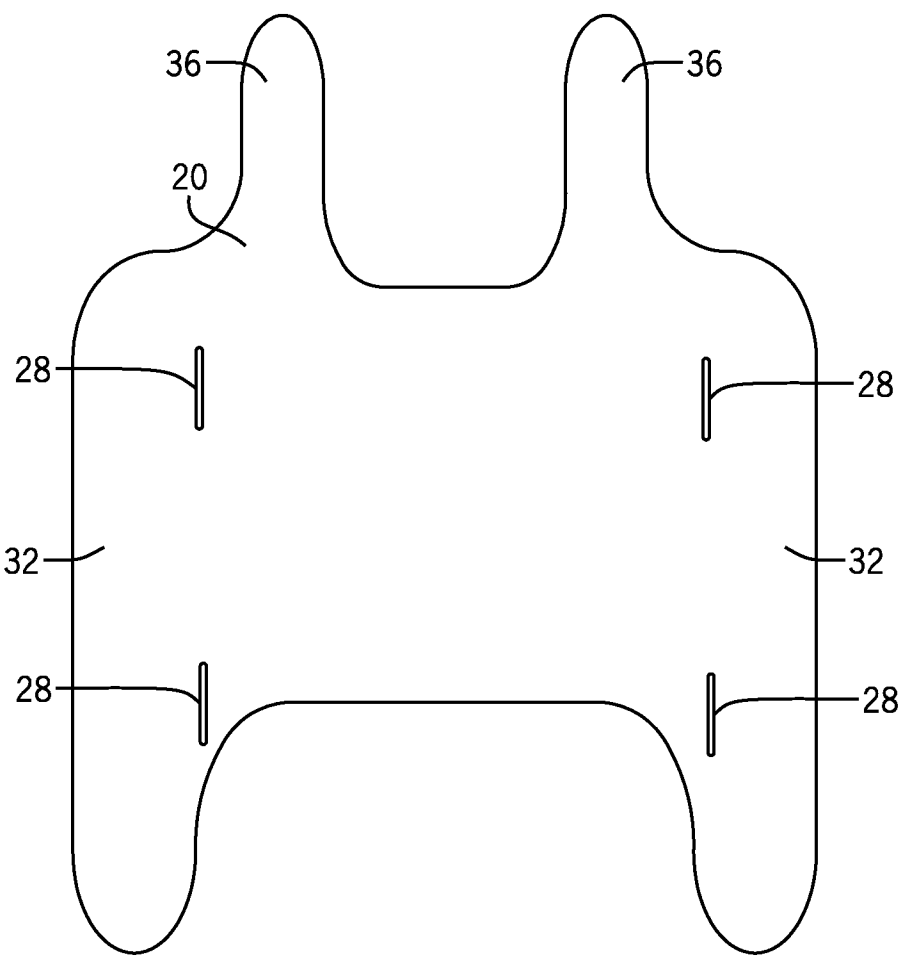
FIG. 4 is a top view of a cushioning mat for use with the patient positioning device of FIG. 1.
Figure 3:
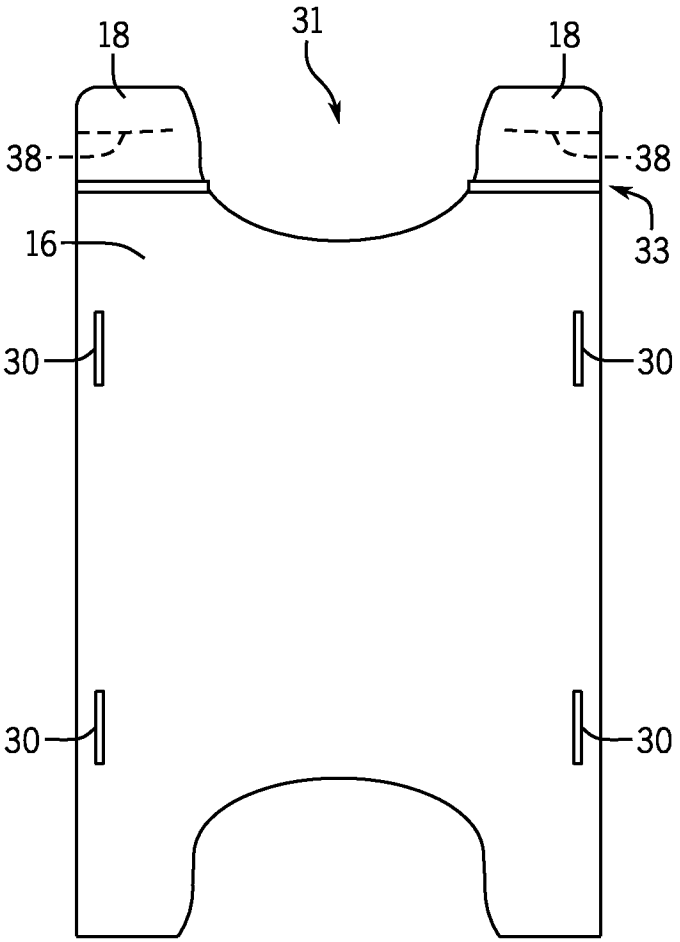
FIG. 3 is a top view of a main board and detachable shoulder supports for use with the patient positioning device of FIG. 1.

The main board 16, as shown in FIGS. 1 and 3, can be a radiolucent plastic backing board and can be shaped to support at least the patient's back when the patient is placed on the device 10. The cushioning mat 20, as shown in FIGS. 1 and 4, can be a flexible gel mat positioned over the main board 16 to provide soft cushioning along all areas of patient contact with the device 10. The cushioning mat 20 can be positioned over the main board 16 so that slots 28 on the cushioning mat 20 align with slots 30 on the main board 16. The straps 22 (such as Velcro® straps) can be routed through the slots 28, 30 to encircle and immobilize the patient's arms. More specifically, the slots 28, 30 can extend vertically through the cushioning mat 20 and the main board 16, respectively, so that the straps 22 can be routed vertically through both the cushioning mat 20 and the main board 16. In some implementations, the slots 28, 30 can extend vertically through the cushioning mat 20 and the main board 20, respectively, as well as horizontally through a portion of the length or width of the cushioning mat 20 or the main board 20, respectfully. For example, in one implementation, the slots 30 can extend from a side edge of the main board 16 through the top of the main board 16. FIGS. 1-4 show two straps 22 along each side of the device 10, providing two points of immobilization along each of the patient's arms. However, in other implementations of the invention, more or less straps 22 can be used.

As shown in FIG. 4, arm extensions 32 of the cushioning mat 20 can extend a substantial amount outward from the slots 28, in comparison to the main board 16 relative to the slots 30. When immobilizing the patient 12, the arm extensions 32 can be wrapped at least partially around the patient's arms and each strap 22 can be routed through corresponding slots 28, 30, around the respective arm extension 32, and attached to itself. Therefore, as shown in FIG. 2, the straps may be arranged to only wrap around the patient's arms. This allows uninhibited access to the chest wall and abdomen of the patient 12 for a surgeon or anesthesiologist at all times during a surgical procedure. In addition, as shown in FIG. 1, the arm extensions 32 can be large enough to reduce the amount of contact between the straps and the patient's arms, while still allowing substantial access to the patient's arms, for example for additional intravenous lines or peripheral nerve stimulators to be placed. In some implementations of the invention, the arm extensions 32 can be large enough to substantially envelope the patient's arms when the patient 12 is positioned by the device 10. Also, in some implementations, the straps 22 may be wrapped completely around the device 10 and the patient 12 (for example, over the patient's torso).

Figure 5:
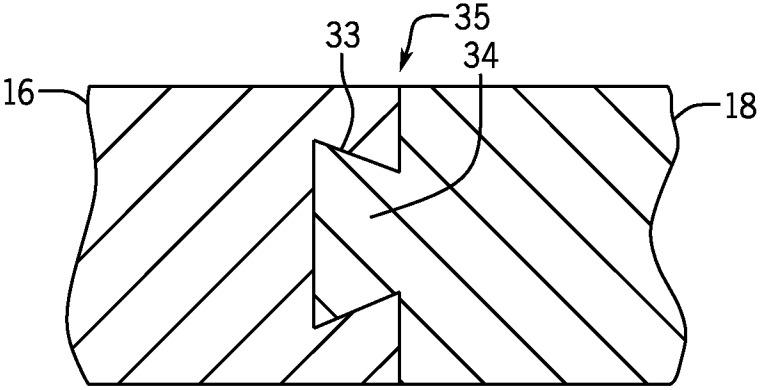
FIG. 5 is a partial cross-sectional view of an interlocking mechanism for coupling the main board and the detachable shoulder supports of FIG. 3.

The two detachable shoulder supports 18 can be identical and can each be individually coupled to either side of one end of the main board, thus providing a hollow area 31 between the shoulder supports 18 for the patient's neck and head. The shoulder supports 18 can be configured for engagement with the main board 16 via a slide-bar type interlocking mechanism 35, as shown in FIG. 5, or through another suitable coupling manner. More specifically, FIG. 5 illustrates the board 16 as including a receptacle key portion 33 and the shoulder supports 18 as including a protruding key portion 34 that together form a slide-bar type locking system. Such a slide-bar type locking system is but one example of a locking mechanism 35 consistent with the present invention. That is, the shoulder supports 18 can be coupled and removed from engaging the main board 16 by way of a locking mechanism 35. The locking mechanism 35 may be formed, for example, as an interlocking system, such as illustrated in FIG. 5, or other suitable system that facilitates rapid engagement and removal of the shoulder supports 18 from the main board 16 without the need for tools or the coordinated activities of multiple parties. As a result, the locking mechanism 35 is designed to allow rapid engagement and removal of the shoulder supports 18 from the main board 16 without manipulating cumbersome systems, requiring tools, or coordinating multiple clinicians.

Figure 6:
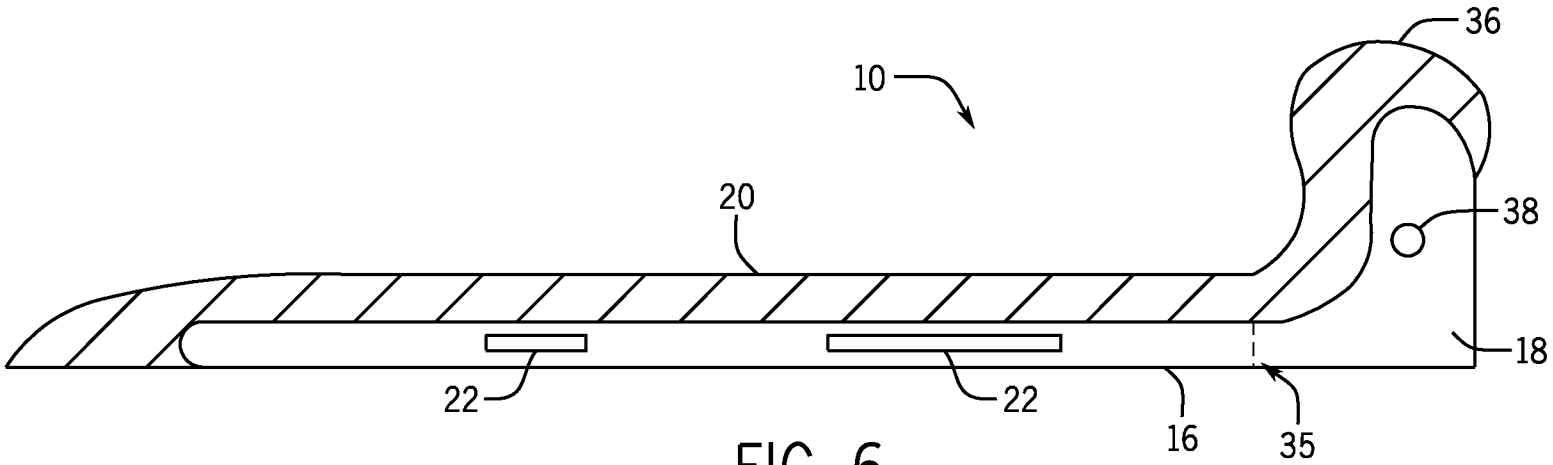
FIG. 6 is a side view of the patient positioning device of FIG. 1.
Figure 7:
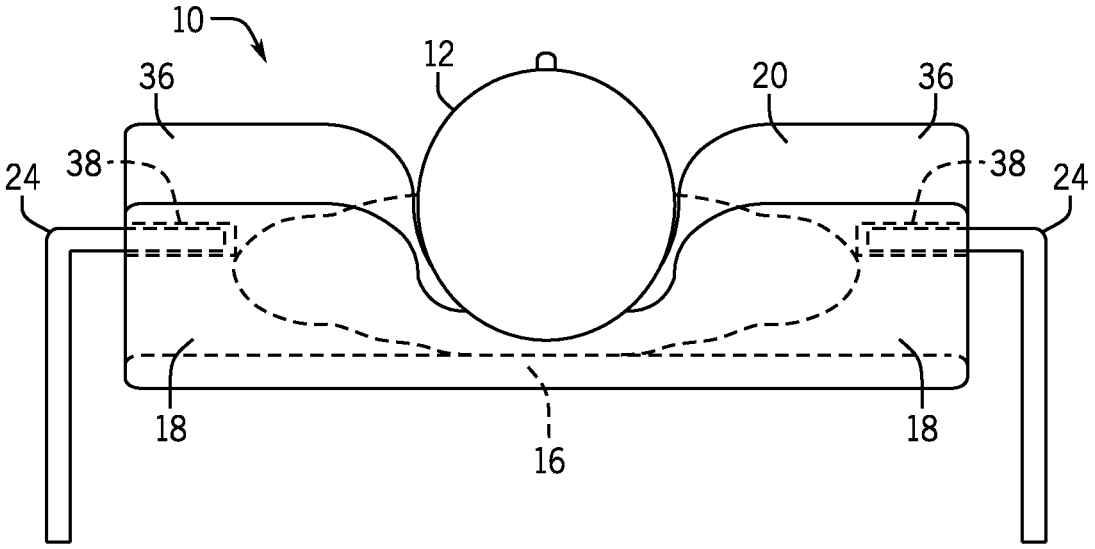
FIG. 7 is a front view of the patient positioning device of FIG. 1.

When coupled together, shoulder supports 18 can extend substantially perpendicular from the main board 16 to prevent the patient 12 from sliding down the main board 16 when in the Trendelenburg position (that is, when the operating table 14 is rotated about an inclined or declined angle). In addition, shoulder portions 36 of the cushioning mat 20 can extend substantially past the main board 16 so that they conform around the shoulder supports 18, as shown in FIGS. 6 and 7. As a result, the cushioning mat 20 can be positioned over the main board 16 and the shoulder supports 18, when connected to the main board 16, so that the cushioning mat 20 lies between the patient 12 and the main board 16 and the shoulder supports 18 when the patient is placed on the device 10. In other words, the patient's shoulders can be flush with the cushioning mat 20 when the shoulder supports 18 are attached to the main body, therefore relieving pressure placed on the patient's shoulders when the in the Trendelenburg position. Thus, the cushioning mat 20 can provide ample cushioning for the shoulders, as well as the neck, arms, upper torso and other pressure points on the patient 12, reducing the risk for pressure-related injuries, such as nerve injuries, when the patient 12 is positioned by the device 10 for a prolonged time period.

Without the shoulder supports 18 attached to the main board 16, the shoulder portions 36 of the cushioning mat 20 can lie flat against the operating table 14. Thus, in the event of an emergency or if an anesthesiologist needs access to the neck to put in a central line, one or both of the shoulder supports 18 can be quickly and easily removed from the main board 16, causing the cushioning mat 20 to lie flat and allowing uninhibited access to the neck of the patient 12. The detachable shoulder supports 18 also allow the patient 12 to be anesthetized without encumbrances. For example, the patient 12 can be first anesthetized when the patient 12 is lying flat without the shoulder supports 18 attached to the main board 16. After being anesthetized, the shoulder supports 18 can be attached and the secured patient 12 can be placed in a Trendelenburg position.

Figure 8:
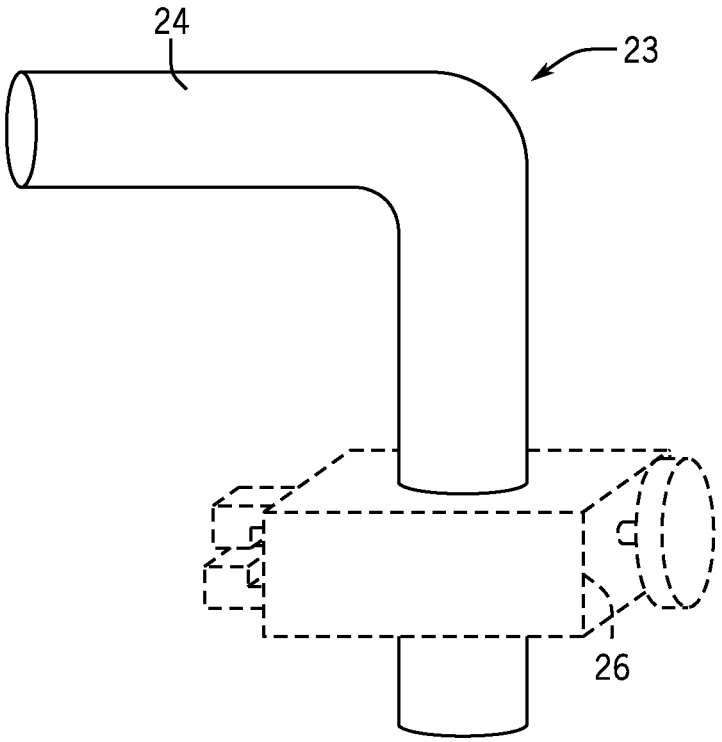
FIG. 8 is a perspective view of a rod and a clamp for use with the patient positioning device of FIG. 1.

To prevent the device 10 itself from sliding down the operating table 14, the shoulder supports 18 can be removably affixed or coupled to the operating table 14 via the coupling mechanism 23, as illustrated in FIG. 1. In some implementations, the coupling mechanism 23 can include a rod 24 and a clamp 26, as shown in FIG. 8. For example, each shoulder support 18 can including a receiving aperture 38 that receives one end of the rod 24 (such as an L-shaped rod). The rod 24 can be permanently installed within the receiving aperture 38 or detachable from the receiving aperture 26. The other end of the rod 24 can be coupled to the clamp 26 (such as a side-rail clamp or Clark socket) that is fixed to the operating table 14. In some implementations of the invention, other suitable coupling mechanisms 23 can be used to secure the device 10 to the operating table 14. Since the coupling mechanism 23 is coupled to the detachable shoulder support 18, the patient 12 can be immobilized on the main board 16 and cushioning mat 20 and still easily moved when the shoulder supports 18 are detached, for example from a gurney onto the operating table 14. The main board 16, being constructed of plastic or other hard materials, can allow for easier transfer of an immobilized patient 12 in comparison to other commonly used immobilization devices such as wraps or bean bag positioners. Also, in some implementations of the invention, the rods 24 can be coupled to the main board 16 to provide easier removal of the shoulder supports 18 in the event of an emergency.

Figure 9:
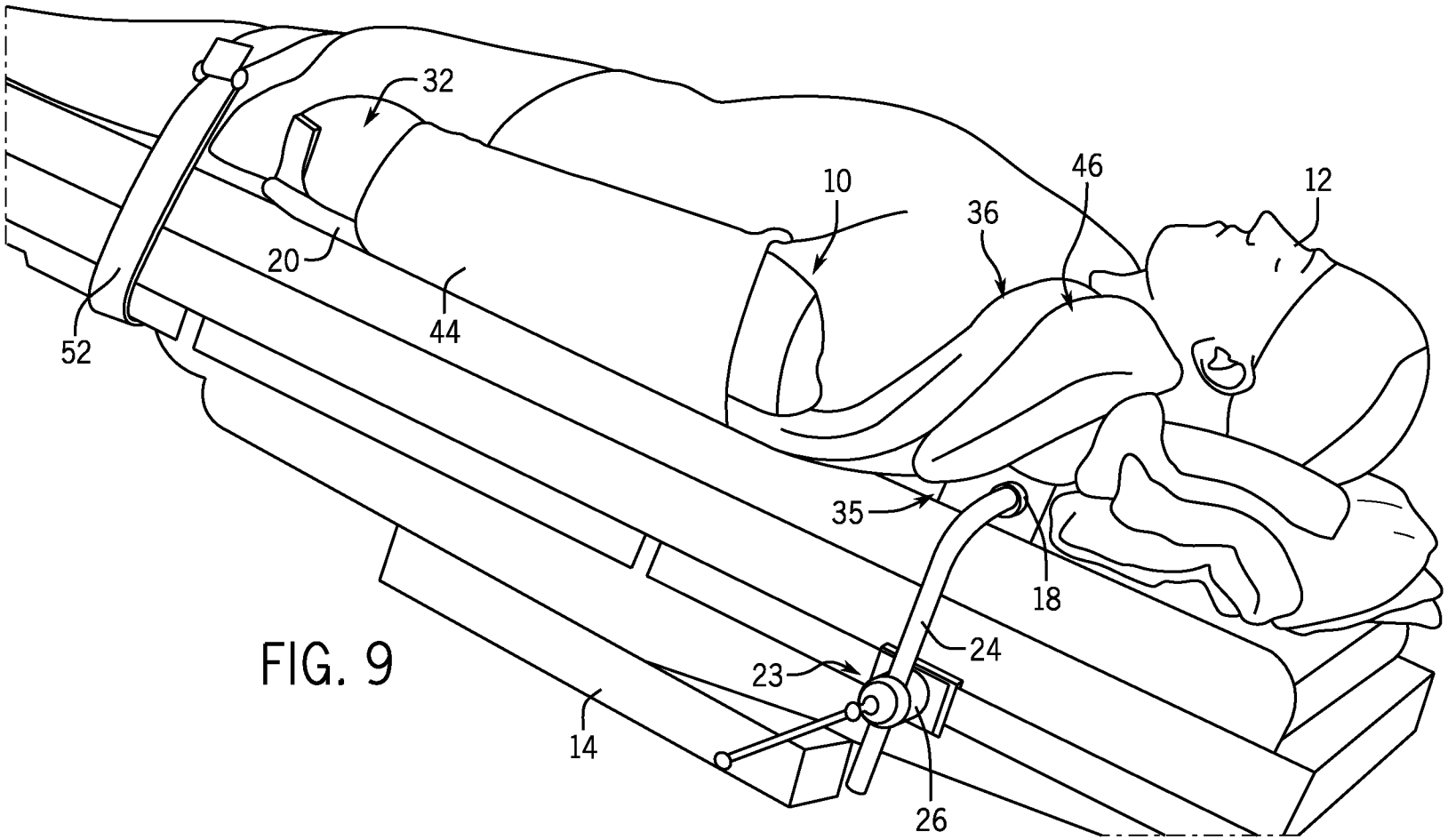
FIG. 9 is a side view of a patient and patient positioning device in accordance with another implementation of the present invention.
Figure 11:
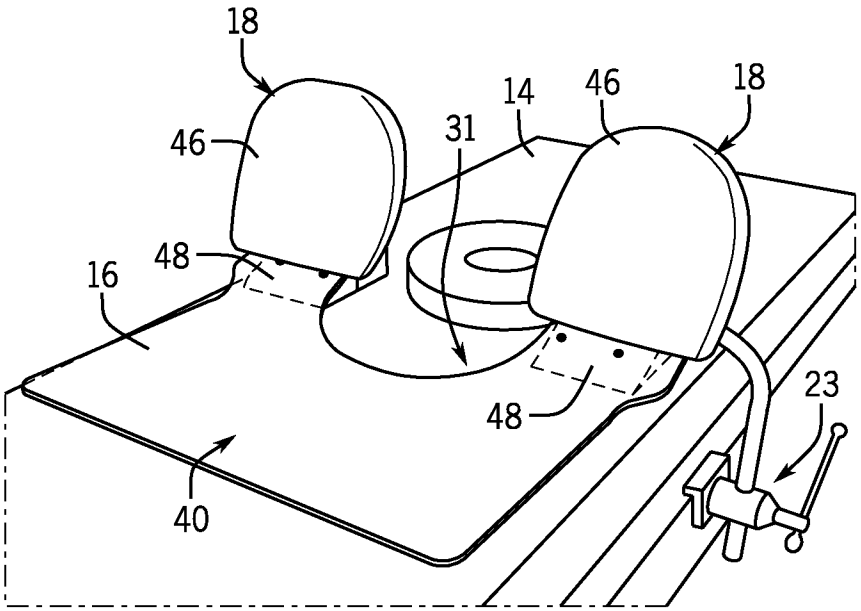
FIG. 11 is another top perspective view of a main board and detachable shoulder supports for use with the patient positioning device of FIG. 9.
Figure 10:
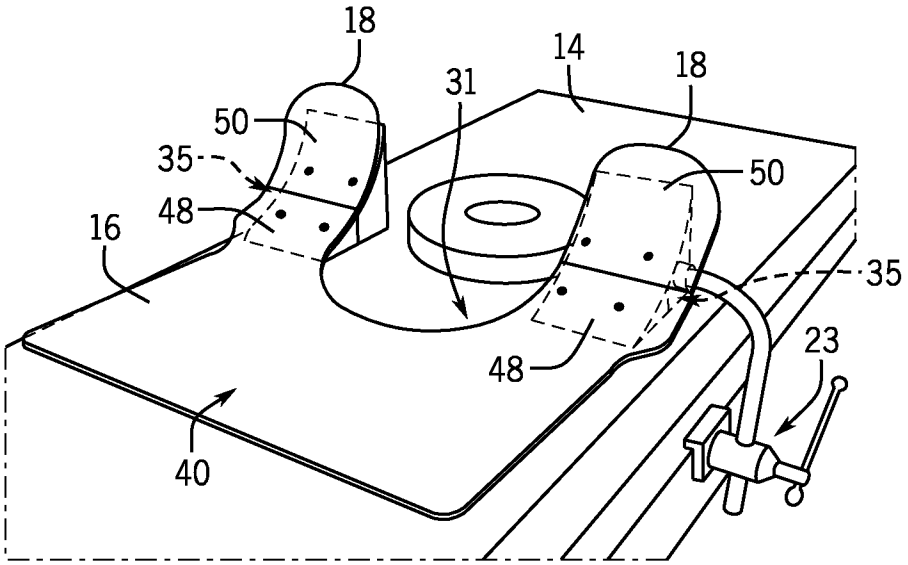
FIG. 10 is a top perspective view of a main board and detachable shoulder supports for use with the patient positioning device of FIG. 9.
Figure 12:
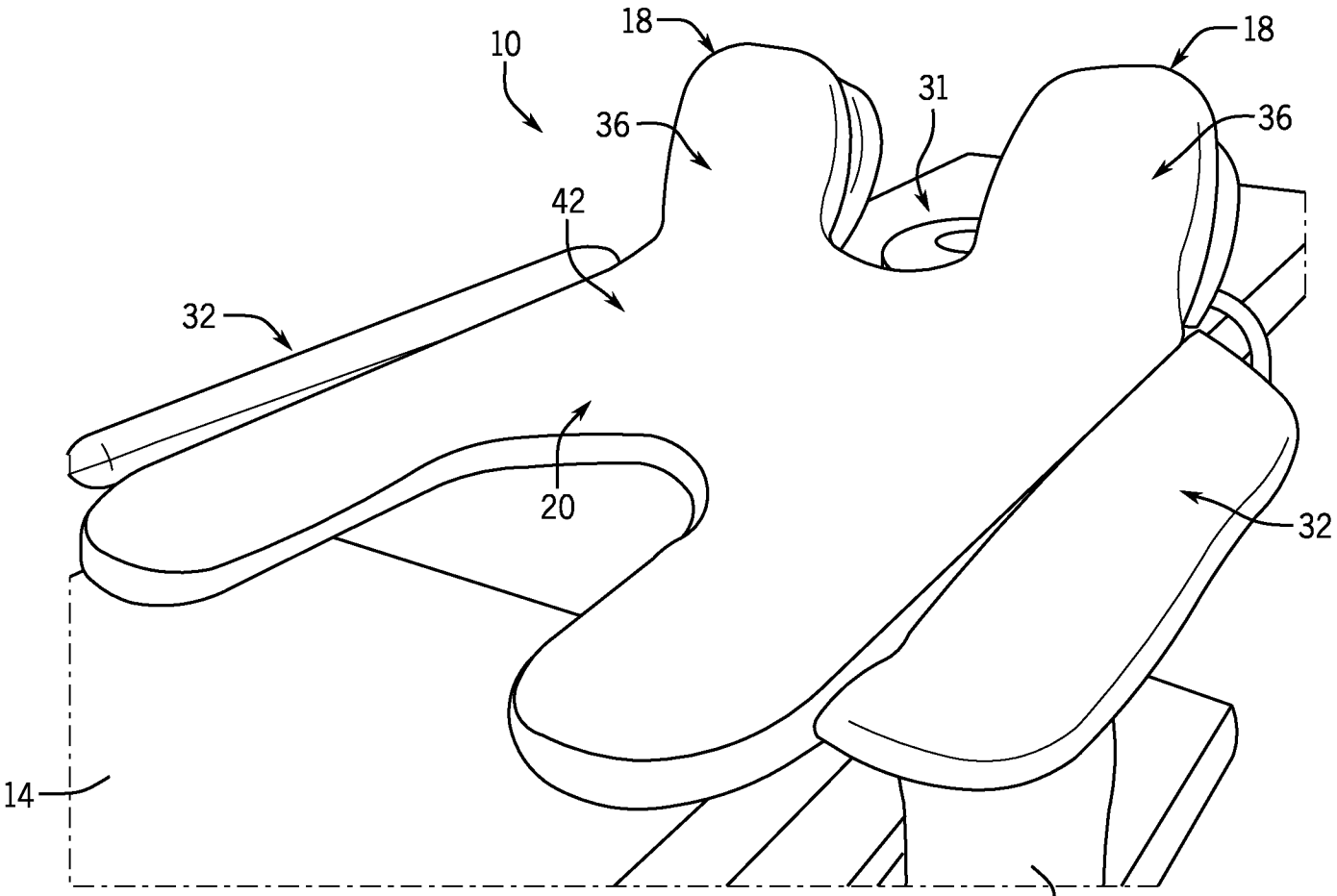
FIG. 12 is a top perspective view of the patient positioning device of FIG. 9.
Figure 13:
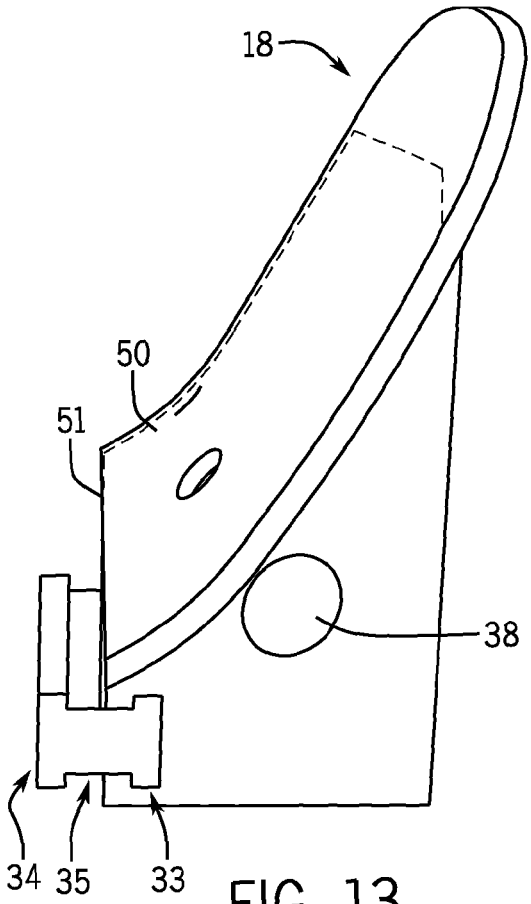
FIG. 13 is a side view of a detachable shoulder support for use with the patient positioning device of FIG. 9.
Figure 14:
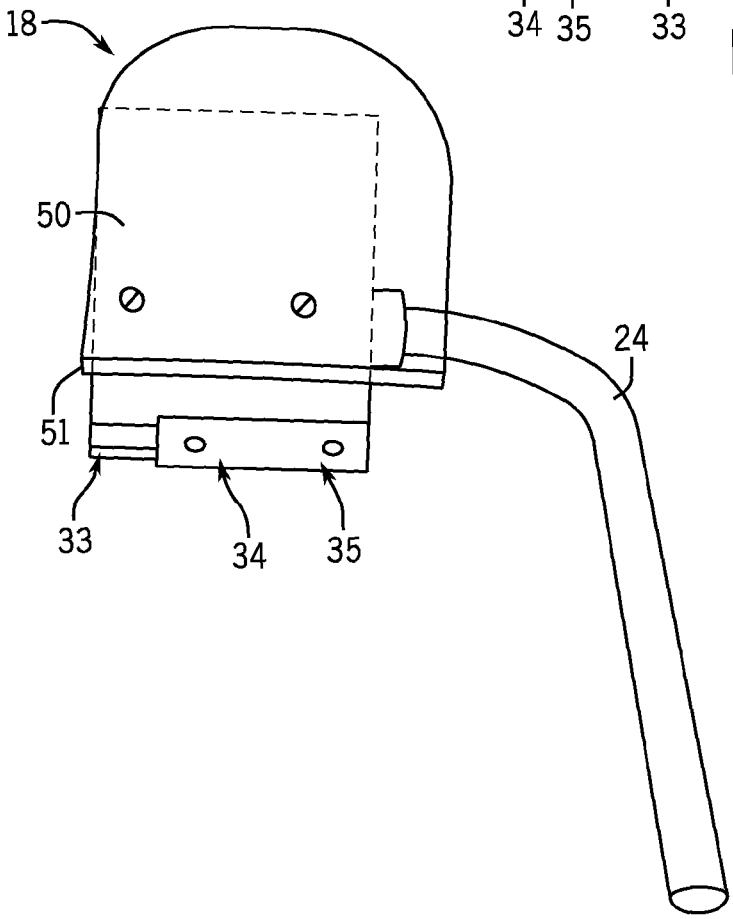
FIG. 14 is a front view of a detachable shoulder support for use with the patient positioning device of FIG. 9.
Figure 15:
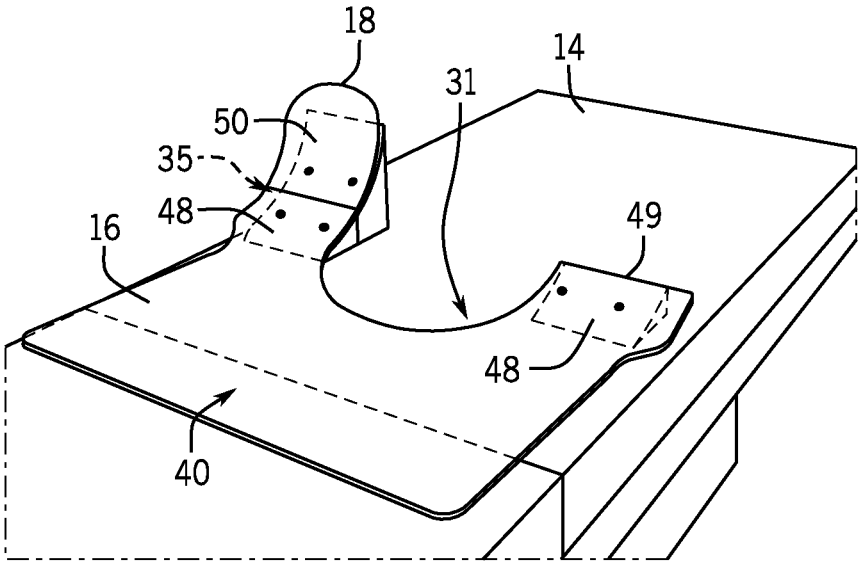
FIG. 15 is a top perspective view of a main board and an attached shoulder support for use with the patient positioning device of FIG. 9.

FIGS. 9-16 illustrate a patient positioning device 10 according to another implementation of the invention. As shown in FIGS. 9-16, the device 10 can include a main board 16, detachable shoulder supports 18, a cushioning mat 20, a coupling mechanism 23 including rods 24 and clamps 26, and a locking mechanism 35. The device 10 of FIGS. 9-16 can include similar features and components as described above with respect to the device 10 of FIGS. 1-8 with the exception of the following differences described herein, though such differences may also be contemplated within the device 10 of FIGS. 1-8. First, the device 10 of FIGS. 9-16 can include a smaller main board 16, as shown in FIGS. 10, 11, and 15, thus reducing cost and weight of the device 10. Second, the main board 16 can include a non-slip upper surface 40 to increase friction between the main board 16 and the cushioning mat 20. The non-slip surface 40 can substantially prevent the cushioning mat 20 from slipping when the operating table 14 is in an inclined or declined position and, thus, increase the safety of the device 10. Third, arm extensions 32 of the cushioning mat 20 can be stitched together with a main portion 42 of the cushioning mat 20 and/or otherwise coupled (or removably coupled) to the main portion 42. The arm extensions 32 can be moved between a first position that is substantially flat and in line with the main portion 42, as shown in FIG. 12, and a second position substantially perpendicular to the main portion 42, as shown in FIG. 9. In other words, the arm extensions 32 can be movable relative to the main portion 42 to allow bending of the arm extensions 32 so that they are wrapped at least partially around the patient's arms, as shown in FIG. 9. With respect to immobilizing the patient 12, the main board 16 and the cushioning mat 20 do not include respective slots, but rather the patient 12 may be secured with a sheet 44 binding the patient's arms, as shown in FIG. 9 and further described below. Fourth, the shoulder supports 18 can include additional removable shoulder pads 46 that can be slid on and off the shoulder supports 18, as shown in FIGS. 9 and 11.

Figure 16:
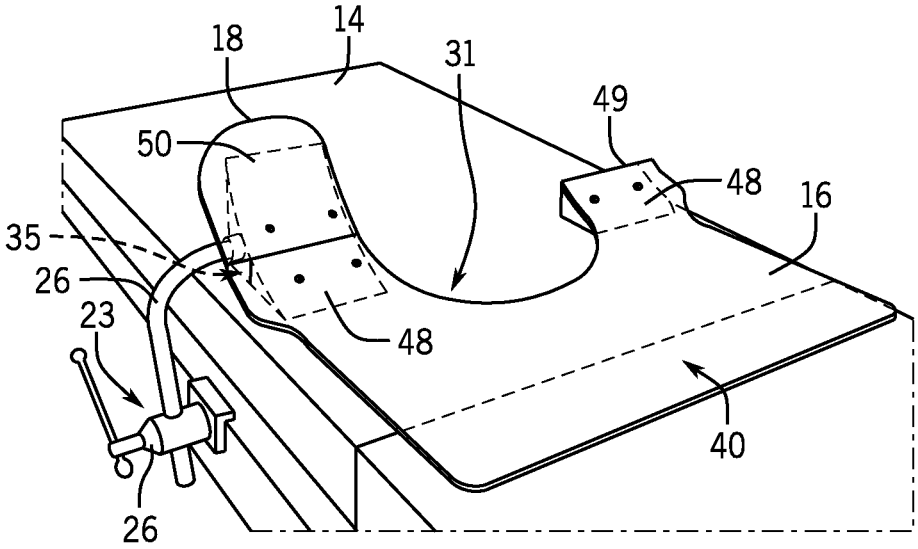
FIG. 16 is another top perspective view of a main board and an attached shoulder support for use with the patient positioning device of FIG. 9.

In addition, the main board 16 can include inclined portions 48 near the locking mechanism 35, for example, to facilitate positioning the patient 12 on the device 10. In other words, the inclined portions 48 are located near an attachment point 49, shown in FIGS. 15 and 16, that receives a corresponding attachment point 51 of the shoulder support 18, as shown in FIGS. 13 and 14, via the locking mechanism 35. As shown in FIGS. 10, 15, and 16, while the shoulder supports 18 are still set substantially perpendicular to the main board 16, these inclined portions 48 can follow a curvature formed along the top surfaces 50 of the shoulder supports 18. In other words, the inclined portions 48 and the top surfaces 50 can have an equal radius of curvature. Despite the inclined portions 48, the cushioning mat 20 can still lie substantially flat when the shoulder supports 18 are removed, for example to allow access to the patient's neck.

With further respect to the locking mechanism 35, FIGS. 13 and 14 illustrate one of the shoulder supports 18 separated from the main board 16. As shown in FIGS. 13 and 14, the shoulder support 18 can include a receptacle key portion 33 configured to receive a protruding key portion 34. The main board 16 can include another receptacle key portion 33 configured to receive the protruding key portion 34 to form a slide-bar type locking system. In some implementations, the protruding key portion 34 can be permanently coupled to the shoulder support 18 or the main board 16, thus removing the need for the receiving receptacle key portion 33 on that component 18 or 16. FIGS. 15 and 16 illustrate the main board 16 with the shoulder support 18 of FIGS. 13 and 14 removed. In other words, FIGS. 15 and 16 illustrate one of the shoulder supports 18 attached to the main board 16 (that is, in a locked position) and the other one of the shoulder supports 18 separated from the main board 16 (that is, in an unlocked position). In this configuration, access to the patient's neck is available, thus allowing the patient to be anesthetized in a traditional manner. When the patient is ready to be positioned in, for example, steep Trendelenburg position, the other shoulder support 18 can be coupled to the main board 16 (via the locking mechanism 35) as well as the operating table 14 (via the coupling mechanism 23), as shown in FIG. 10.

In addition, in some implementations, additional straps 52 may be wrapped completely around the patient 12 (for example, over the patient's legs, as shown in FIG. 9) to further secure the patient 12 to the operating table 14.

The following paragraph provides an example use of the device 10 (that is, the device 10 of FIGS. 1-8 or the device 10 of FIGS. 9-16) during an operation in which a patient 12 must be placed in a Trendelenburg, steep Trendelenburg, or flexed position, such as for a robotic surgical procedure, urologic surgical procedure, gynecologic surgical procedure, prostatectomy, and the like.

First, a correctly-sized device 10 can be selected based on the patient's size (for example, pediatric, small, medium, large, and the like). When the correct device 10 is selected, the patient 12 can be placed on the main board 16 and cushioning mat 20, without the shoulder supports 18, while the operating table 14 is flat. In one implementation, such as with the device 10 of FIGS. 1-8, the patient 12 can be immobilized by wrapping the straps 22 through the slots 28, 30 and around the patient's arms and the arm extensions 32 (as shown in FIGS. 1 and 2). In another implementation, such as with the device 10 of FIGS. 9-16, the patient 12 can be immobilized by wrapping the sheet 44, positioned under and extending outward from the main board 16, around the arm extensions 32 and the patient's arms so that the sheet 44 is tucked tight between each of the patient's arms and the patient's torso (as shown in FIG. 9). Once anesthesia is induced and/or the patient 12 is intubated, the shoulder supports 18 are attached to the main board 16 by an interlocking feature, such as locking mechanism 35, and attached to the operating table by the rods 24 and clamps 26. At this time, pressure points around the neck can be checked to make sure that the patient's neck rests on the gel cushioning of the cushioning mat 20 in the hollow area 31 between the shoulder supports 18 (as shown in FIG. 7). After checking the pressure points, the operating table 14 can be inclined to position the patient 12 accordingly (that is, in the Trendelenburg, steep Trendelenburg, flexed position, or another inclined or declined position) and the surgical procedure can be executed.

As described above, the device 10 can be sized to accommodate a specific range of patient sizes. For example, the device 10 can be sized so that the main board 16 at least supports the patient's back when the patient 12 is placed on the device 10. The cushioning mat 20 can be sized to overlap the main board 16 so that at least the arm extensions 32 and the shoulder portions 36 extend past the main board 16. One example size of the device 10, such as the device 10 illustrated in FIGS. 1-8, can include a cushioning mat 20 with a total length of about 36 inches and a total width of about 38 inches. The width and length of each shoulder portion 34 of the cushioning mat 20 can be about 5 inches and about 10 inches, respectively. The width and length of each arm extension 32 can be about 9 inches and about 26 inches, respectively. Each slot 28 can be about 3 inches long and the distance between slots 28 across the cushioning mat 20 can be about 24 inches, while the distance between slots 28 lengthwise can be about 10 inches. One example size of the main board 16, such as the main board 16 illustrated in FIGS. 9-16, can include a length of about 19 includes and a width of about 20 inches or about 22 inches. The main board 16 of FIGS. 1-8 can include this same width (that is, about 20 inches or about 22 inches) and a longer length than the main board 16 of FIGS. 9-16.

Thus, the above-described invention provides a device to position a patient in a selected body position on an operating table. The device can include a board sized to support at least the patient's back when the patient is placed on the device, shoulder supports configured to engage the board and extending substantially perpendicular from the board, and a cushioning mat positioned over the board and the shoulder supports so that the cushioning mat lies between the patient and the board and the shoulder supports when the patient is placed on the device. A locking mechanism is configured to removably couple the shoulder supports to the board to allow the cushioning mat to lie flat when the shoulder supports are decoupled from the board and thereby provide access to a neck and shoulders of the patient when the patient is placed on the device. A coupling mechanism is configured to removably affix the shoulder supports to the operating table as the operating table is rotated about a range of incline and decline.

The present invention has been described in terms of one or more preferred embodiments, and it should be appreciated that many equivalents, alternatives, variations, and modifications, aside from those expressly stated, are possible and within the scope of the invention.

We claim:

1. A device to position a patient in a selected body position on an operating table, the device comprising:

a board configured to be placed on and move freely relative to the operating table and sized to support at least the patient's back when the patient is placed on the device;

shoulder supports engaging the board and extending substantially perpendicular from the board;

a cushioning mat positioned over the board and the shoulder supports so that the cushioning mat is configured to lie between the patient and the board and the shoulder supports when the patient is placed on the device;

a locking mechanism removably coupling the shoulder supports to the board to allow the cushioning mat to lie substantially flat when the shoulder supports are decoupled from the board and thereby configured to provide access to a neck and shoulders of the patient when the patient is placed on the device; and a coupling mechanism including a rod coupled to each of the shoulder supports and a clamp engaging each rod and configured to be coupled to the operating table, the coupling mechanism configured to removably affix the shoulder supports to the operating table as the operating table is rotated about a range of incline and decline positions.

2. The device of claim 1, wherein the board includes a length of about 19 inches and a width of one of about 20 inches and about 22 inches.

3. The device of claim 1, wherein the rod is an L-shaped rod and the clamp is a side-rail clamp.

4. The device of claim 1 wherein the main board is constructed of a radiolucent plastic material.

5. The device of claim 1 wherein the cushioning mat is constructed of a gel cushioning material.

6. The device of claim 1 wherein the locking mechanism includes a slide-bar type interlocking mechanism.

7. The device of claim 6 wherein the slide-bar type interlocking mechanism is formed by a reciprocal key portion formed on one of the shoulder supports and the board and a protruding key portion formed on an other of the shoulder supports and the board.

8. The device of claim 1 wherein the cushioning mat includes a main portion and arm extensions, wherein the arm extensions are moveable relative to the main portion.

9. The device of claim 1 wherein the board including a non-slip upper surface.

10. The device of claim 1 and further comprising shoulder pads removably coupled to the shoulder supports.

11. The device of claim 10, wherein the cushioning mat is positioned over the shoulder pads.

12. The device of claim 1, wherein the board includes an inclined portion adjacent to the locking mechanism and the shoulder supports include curved surfaces, wherein the included portion and the curved surfaces follow an equal radius of curvature.

13. The device of claim 1 wherein the board includes first slots and the cushioning mat includes second slots, and further comprising straps extending through the first slots of the bard and the second slots of the cushioning mat to encircle the patient's arms when the patient is placed on the device.

14. The device of claim 13 wherein each one of the straps is routed through one of the first slots, through one of the second slots, around one of the patient's arms, and attached to itself to secure the patient to the device when the patient is placed on the device.

15. The device of claim 13 wherein the cushioning mat and the board are configured to be positioned relative to each other to align the first and second slots.

* * * * *